United States Patent [19]

Panetti

[11] Patent Number: 4,596,092

[45] Date of Patent: Jun. 24, 1986

[54] DEVICE FOR THE CONTINUOUS REPROFILING OF THE HEAD OF AT LEAST ONE RAIL

[75] Inventor: Romolo Panetti, Geneva, Switzerland

[73] Assignee: Speno International S.A., Geneva, Switzerland

[21] Appl. No.: 666,314

[22] Filed: Oct. 30, 1984

[30] Foreign Application Priority Data

Nov. 16, 1983 [CH] Switzerland ..... 6152/83

[51] Int. Cl.[4] ..... E01B 31/17

[52] U.S. Cl. ..... 51/178

[58] Field of Search ..... 51/178

[56] References Cited

U.S. PATENT DOCUMENTS 3,707,808 1/1973 Danko et al. .
4,347,688 9/1982 Scheuchzer et al. ..... 51/178

FOREIGN PATENT DOCUMENTS 0032214 7/1981 European Pat. Off. .
1479320 5/1967 France .
2333897 7/1977 France .
2405320 5/1979 France .
6597 8/1965 Japan ..... 51/178
463555 11/1968 Switzerland .
606616 11/1978 Switzerland .
1151010 5/1969 United Kingdom .

*Primary Examiner*—Roscoe V. Parker
*Attorney, Agent, or Firm*—Young & Thompson

[57] ABSTRACT

The device for reprofiling the head of at least one rail comprises a support (1, 2, 12, 13, 9) carrying at least one grinding unit (3, 4, 6, 7) pivotally mounted about an axis (8) extending parallel to the longitudinal axis of the rail (11). This grinding unit has a grinding wheel (3) driven in rotation by a motor (4) and structure (7) for displacing axially the grinding unit (3) to apply it against a side line of the head of the rail (11) and thus compensate its wearing off. It comprises structure (9, 10, 19, 20, 21) for displacing the axis of pivoting (8) of the grinding unit (3, 4, 6, 7) parallel to itself, in a direction transverse to the longitudinal axis of the rail (11). Servo-mechanism is provided to make dependent on each other the pivoting of the grinding unit (3, 4, 6, 7) and the displacement of its axis of pivoting (8).

9 Claims, 6 Drawing Figures

DEVICE FOR THE CONTINUOUS REPROFILING OF THE HEAD OF AT LEAST ONE RAIL

For the reprofiling of rails one uses now machines comprising pivoting grinding units which are controlled since it is therewith possible to reduce the number of grinding wheels necessary and therefore to create compact machines. These machines having controlled pivoting grinding units, such as the ones described in the patent Nos. CH 463,555, CH 606,616, or CH 633,336, have among others the drawback of necessitating at each angular adjustment of the position of the grinding wheel a repositioning of the grinding wheel against the rail to be ground. Furthermore the amplitude of the pivoting of the grinding units is limited.

The problem which is now encountered with the rails reprofiling machines is to be able, with the same grinding wheel, to grind the face, the inside shoulder and the rolling table as well as the outside shoulder of the rail. This is particularly indispensable when the rails are prepared for interchange, i.e. the replacement of the left rail of a railway track by its right one and vice-versa. With the existing machines, that can be done only with manual adjustments which are time consuming of cumbersome grinding units, their axial stroke, parallel to the axis of rotation of the grinding wheel, having to be great. Finally, these great axial strokes affect the precision of the grinding.

The aim of the present invention is therefore to realize a machine the grinding wheel or wheels of which may pivot over a great angle, about 180°, that is to say an angle much greater than in the existing machines, while avoiding that during its pivoting the grinding wheel enters in conflict with the obstacles it could find along the track, such as rail splices, etc. Furthermore to guarantee a good grinding quality, it is to be avoided that a modification of the inclination of the grinding wheel brings with it an important correction of its axial position, parallel to its axis of rotation, to bring it back against the rail.

The present invention has for its object the provision of a device for reprofiling the head of at least one rail comprising a support carrying at least one grinding unit, pivotably mounted around an axis extending parallel to the longitudinal axis of the rail, having at least one grinding wheel driven in rotation by a motor and means for axially displacing said grinding wheel to apply it against a side line of the head of the rail and thus compensating its wearing off, characterized by the fact that it comprises means for displacing the axis of pivoting of the grinding unit, parallel to itself, along a direction extending perpendicularly to the longitudinal axis of the rail; and servo-mechanism means to make the pivoting of the grinding unit and the displacement of its axis of pivoting dependent on each other.

The attached drawing shows schematically and by way of example three embodiments of the device according to the invention.

Figure 1:
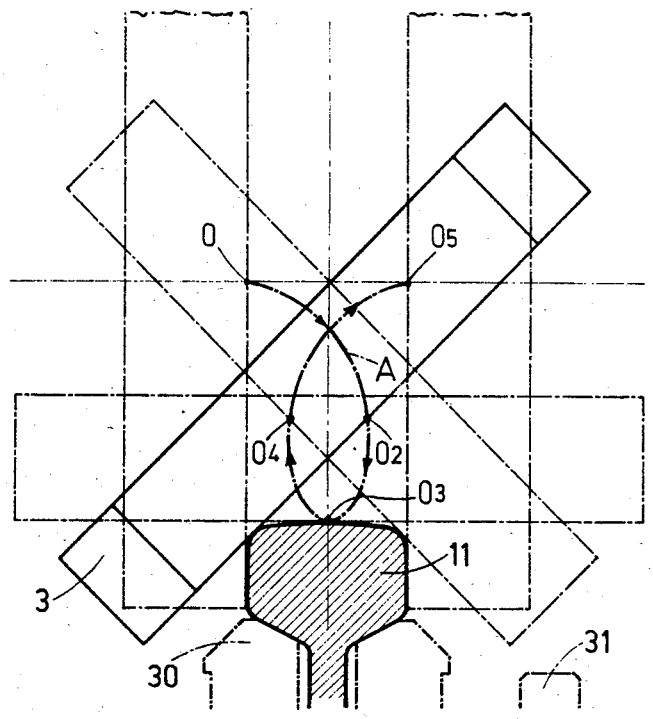
FIG. 1 is a diagram showing the trajectory of the center of the active surface of the grinding wheel during the pivoting of the grinding unit around its axis which is parallel to the longitudinal axis of the rail.
Figure 2:
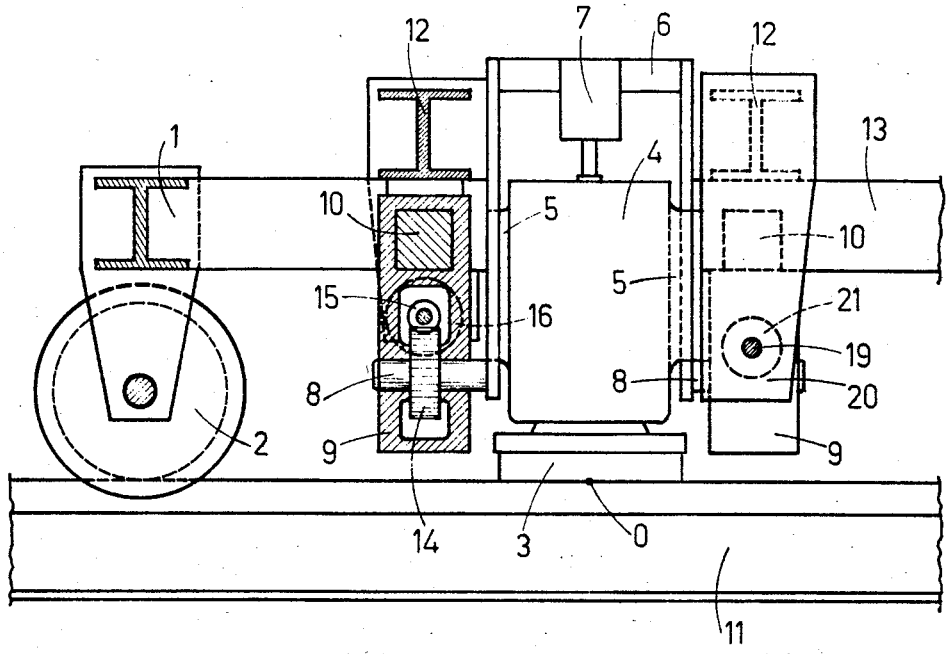
FIG. 2 is a partial side view of a grinding wheel carrying carriage according to a first embodiment.
Figure 3:
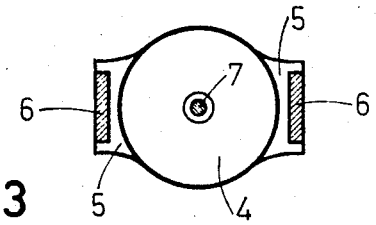
FIG. 3 is a partial top view of the device shown in FIG. 2.
Figure 4:
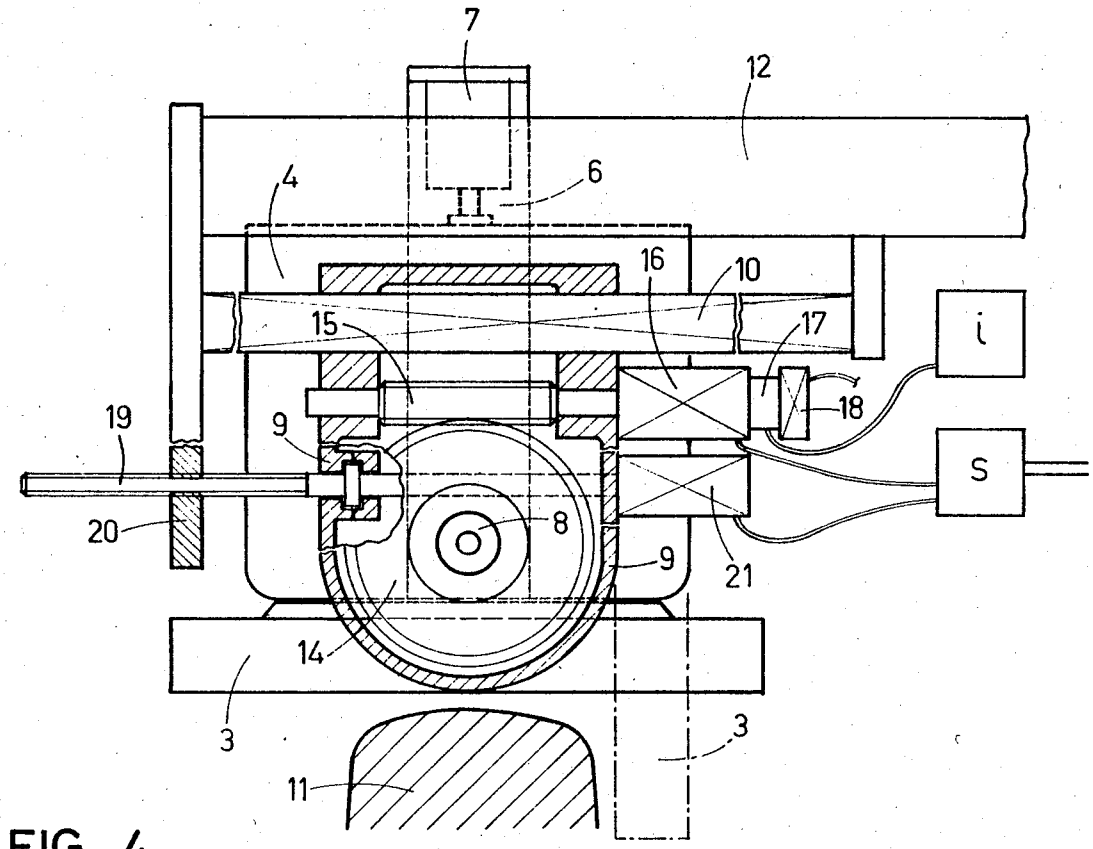
FIG. 4 is an end view of the device shown in FIG. 2.

FIG. 1 shows schematically the principle of the displacement of a grinding wheel according to the present invention. To obtain the desired result, that is the pivoting of the grinding wheel through 180° while maintaining it in contact with the rail, or when this is deformed, in its immediate vicinity, the center O of the active surface of the grinding wheel is displaced along the line A while rotating the grinding wheel around an axis parallel to the longitudinal axis of the rail. The center of the active surface is displaced from 0 to 02, 03, 04 and 05 successively for successive angular positions of the grinding wheel displaced 45° from each other in the example shown, but this active surface of the grinding wheel remains always in contact with or in the immediate vicinity of the head of the rail.

Such a movement of the grinding wheel 3 can be obtained thanks to the combination of a rotation of the grinding unit around an axis parallel to the longitudinal axis of the rail and a displacement of said axis of pivoting, parallel to itself, in a direction perpendicular to the longitudinal axis of the rail 11.

The first embodiment of the device for the continuous reprofiling of the head of at least one rail of a railroad track comprises a carriage 1 provided with flanged wheels 2 which are applied preferably without play against the rails through adequate means. This carriage 1 is thus guided longitudinally and transversely by the rails and is connected to a railway vehicle (not shown) by means permitting its traction. This carriage 1 is further connected to the railway vehicle by lifting means causing a relative displacement in height between the carriage 1 and the railway vehicle.

On this carriage 1, at least one grinding unit is mounted so as to be angularly displacable with respect to it around an axis substantially parallel to the longitudinal axis of the rail. Each grinding unit comprises a grinding wheel 3 driven in rotation through a motor 4 sliding by means of slides 5 on a yoke 6 parallel to the axis of rotation of the grinding wheel 3. This axial rectilinear displacement of the grinding unit permits applying it with a given force against the surface of the head of the rail and compensating for its wearing off. A jack 7 connects the yoke 6 to the motor 4 and enables thus applying the grinding wheel 3 against a side line of the rail to be ground with a given force by causing axial displacements to compensate the wearing off of the grinding wheel.

The yoke 6 comprises two coaxial trunnions 8, forming the axis of pivoting of the grinding unit, which are pivoted in a sliding block 9 sliding on transverse guide rods 10 of the carriage 1, that is extend perpendicular to the longitudinal plane of symmetry of the carriage 1 and to the rail 11 which is to be ground.

These guiding rods are connected to cross members 12 of the carriage, which are themselves fixed to central beams 13 of the frame of the said carriage 1.

In this manner, the guiding unit 3, 4, 7 is mounted on the carriage 1 so that it can pivot around an axis extending parallel to the longitudinal axis of the rail; this axis of pivoting being displacable parallel to itself in a direction perpendicular to the axis of said rail. In the example shown this displacement of the axis perpendicular to the axis of the rail 11 is rectilinear but in variants it could be linear, along a curve or otherwise.

In the example illustrated, the grinding unit 3, 4, 7 comprises driving means for driving it in its pivoting movement around the axis which is materialized by its two trunnions 8. These means comprise a toothed wheel 14, fast with a trunnion 8, meshing with an helicoidal screw 15 journaled in the sliding block 9 and driven in rotation for example by means of a stepping motor 16. These means could further comprise, as in the example shown, a sensor 17 feeding a display i of the angular position of the helicoidal screw 15 with respect to the sliding bloc. This angular information corresponds to the inclination of the grinding unit 3, 4, 7 with respect to the carriage 1.

An electromagnetic brake 18 can be provided to lock the grinding unit in a given angular position, this being necessary for this angular position of said grinding unit to be fixed during a grinding operation in the selected position corresponding to the grinding of a given side line of the rail 11.

In the example shown, the grinding unit 3, 4, 7 comprises further means for displacing the axis of pivoting of the grinding unit comprising a screw 19 cooperating with a part 20 fixed to the cross member 12 of the carriage constituting a nut. This screw is pivoted in holes of the sliding block 9 but cannot be displaced axially relative thereto. A stepping motor 21 drives the screw 19 in rotation and displaces the sliding block 9 along its guiding rods 10.

A sensor can also be provided to detect the angular position of the screw 19 and thus the position of the sliding block 9 with respect to the carriage 1, an electromagnetic locking of the screw can be provided as well to fix the position of the sliding bloc 9 with respect to the carriage 1.

Servo-mechanism means are provided to make dependent on each other the pivoting of the grinding unit and the displacement of its pivoting axis. In this realization these means are formed by an electric synchronization device S of the two stepping motors 16 and 21 so that the angular displacements of the grinding unit and the displacement of its pivoting axis will be such that the center O of the active surface of the grinding wheel 3 follows the line A of FIG. 1. In this way the grinding wheel 3 can pass from an horizontal position to a vertical position, while its active surface always remains substantially at the same distance from the surface of the head of the rail 11, or in contact with it.

Thanks to this arrangement and to the displacements in rotation and in translation of the grinding unit, the axial stroke of the grinding wheel is substantially limited to the axial stroke necessary to compensate for the wearing off of the grinding wheel and for its setting in retracted, out of service, position. Under these conditions, the space required for the grinding unit is greatly reduced and as a consequence the guiding of the guiding wheel is more precise.

It is to be noted that according to the concept of the invention, the guiding wheel 3 has four degrees of freedom; a pivoting around the axis of pivoting 8 of the grinding unit; a translation of said axis 8 in a direction perpendicular to the longitudinal axis of the rail; an axial displacement towards the rail and away from it, and a rotation around its own axis.

In a variant it is obvious that for guiding purposes of the grinding unit in its displacement of translation and pivoting, two translation driving means 19, 20, 21 and two pivoting driving means 15, 16 located on either side of the slides 5 can be provided.

In a simplified embodiment only one motor can be used for driving in rotation the helicoidal screw controlling the pivoting of the grinding unit and the screw controlling the displacement of the axis of pivoting of this unit. These two screws could be unitary. In this case, the conjugated movement, translation-pivoting of the grinding unit is entirely determined by the construction and depending on the profile of the head of the rail, the grinding wheel remains at a substantially constant distance from the said head of the rail during its displacements. The advantage of this solution is the simplicity of the driving means of the grinding unit in its pivoting and translation.

Figure 5:
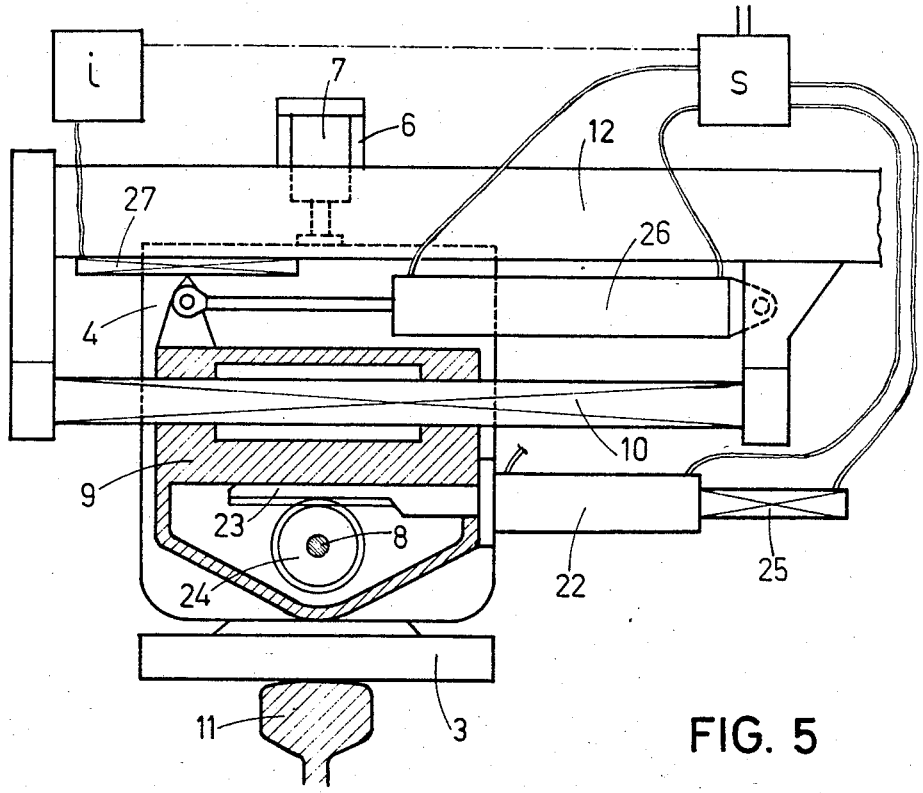
FIG. 5 is a view similar to FIG. 4 of a second embodiment of the device.

In the second embodiment shown in FIG. 5 the grinding unit 3, 4, 7 is mounted on the carriage 1 in the same manner as in the first embodiment, only the driving means of the unit in its pivoting and the driving means of the axis of pivoting of the grinding unit in its displacements are different.

The pivoting of the grinding unit 3, 4 7 around its trunnions 8 is obtained thanks to a jack 22 fixed on the sliding block 9, actuating a toothed rack 23 meshing with a pinion 24 fast with the trunnion 8. A sensor 25 delivers an indication relative to the inclination of the grinding unit as a function of the linear position of the piston of the jack 22.

The driving of the axis of pivoting in its displacement and thus the translation of the grinding unit is effected by means of a jack 26, fast with the carriage, the piston of which moves on the sliding block 9 along the grinding rods 10. A position detector 27 delivers an indication of the position of the sliding block 9 with respect to the carriage 1 to a position display i.

Here also a servo-mechanism S causes the synchronized feeding of the jacks with driving fluid so that the center O of the active surface of the grinding wheel 3 follows the path A shown in FIG. 1 so that for all inclinations of the grinding wheel its distance to the head of the rail remains substantially constant.

Figure 6:
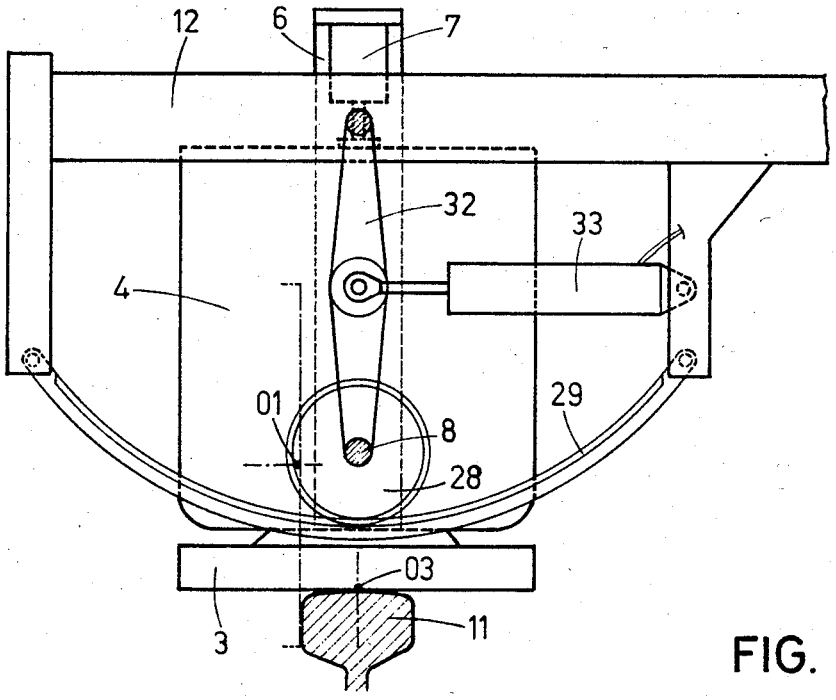
FIG. 6 shows schematically a third embodiment of the device.

In a third embodiment schematically represented in FIG. 6, the grinding unit 3, 4, 7 sliding in the yoke 6 is pivotally mounted by means of the trunnions 8 of the yoke 6 on the free ends of levers 32, the other ends of which are pivoted on the cross member 12 of the carriage 1. These levers are actuated in angular displacements around their hinges on the cross member 12 by means of jacks 33 fast with the carriage and the pistons of which are connected to the middle positions of the levers 32.

In this embodiment the trunnion or trunnions 8 are fast with toothed wheels 28 meshing with the inside toothing of toothed crowns 29 which are fast with the carriage.

Therefore in this embodiment, there is a connection between the pivoting of the grinding unit and the displacement of its pivoting axis which takes place here always parallel to itself in directions transverse to the axis of the rail 11 but along an arcuate path and not a rectilinear one. In such a realization the number of teeth of the crowns 29 and of the toothed wheels 28 is such that the center O of the active surface of the grinding wheel 3 follows the path A of FIG. 1 during the angular displacements of the levers 32.

In a general way it is to be seen that according to the invention it is possible to pivot the grinding wheel so that it can act on the whole surface of the head of the rail while maintaining its distance to the rail substantially constant, even applied against this rail if the driving jack 7 is under pressure. Furthermore, and this is also important, the zone scanned by the grinding wheel during its displacement does not interfere with rail splices 30, sleeper screws 31 or any other obstacle which can be located along or in the vicinity of the rail.

This result is obtained according to the invention in that the grinding unit is mounted on its supporting carriage in such a way that on the one hand it can pivot around an axis parallel to the longitudinal axis of the rail and on the other hand its axis of pivoting undergoes simultaneously a translation in a direction transverse to the longitudinal axis of the rail.

In variants, it is possible to link two grinding units which would then be driven in their pivoting and in their translations by the same driving means.

The grinding units can be lapidary or peripheral grinding wheels.

All the embodiments described relate to the continuous on track grinding of the rails of a railroad track already in place. However, it is evident that the reprofiling device can be mounted on a fixed support and that means can be provided to move a rail with respect to said support. In this way it is possible to reprofile all sorts of rails in the workshop.

I claim:

1. Device for reprofiling the head of at least one rail comprising a support carrying at least one grinding unit, pivotally mounted around an axis extending parallel to the longitudinal axis of the rail, having at least one grinding wheel driven in rotation by a motor and means for axially displacing said grinding wheel to apply it against a side line of the head of the rail and thus compensating its wearing off, characterized by the fact that it comprises means for displacing the axis of pivoting of the grinding unit, parallel to itself, in a direction transverse to the longitudinal axis of the rail; and servo-mechanism means to make the pivoting of the grinding unit and the displacement of its axis of pivoting dependent on each other.

2. Device according to claim 1, characterized by the fact that each grinding unit is pivoted on a sliding block mounted on slides carried by the support; these slides extending perpendicular to the longitudinal axis of the rail.

3. Device according to claim 1, characterized by the fact that each grinding unit comprises a motor driving a grinding wheel in rotation this motor being slidably mounted, in a direction parallel to the axis of rotation of the grinding wheel, on a yoke; the means for axially displacing the grinding wheel being located between the motor and the yoke and causing a sliding movement of the one with respect to the other.

4. Device according to claim 1, characterized by the fact that it comprises driving means of the grinding unit in its pivoting movement comprising a motor, as well as the means displacing the axis of pivoting of said grinding unit; and by the fact that the servo-mechanism synchronizes the two motors so that for a pivoting of about 180° of the grinding wheel, the distance of said grinding wheel with respect to the rail remains substantially constant.

5. Device according to claim 1, characterized by the fact that the grinding unit is linked to the support by means of a linkage synchronizing the pivoting of said grinding unit and the displacement of its axis of pivoting and by the fact that only one motor drives the grinding unit simultaneously in its conjugated displacement of pivoting and translation.

6. Device according to claims 1, characterized by the fact that the means driving the grinding unit in its movement of pivoting and/or of displacement of its axis of pivoting comprise displays of the position of this grinding unit.

7. Device according to claim 1, characterized by the fact that it comprises further locking means of the grinding unit in its different working positions.

8. Device according to claim 1, characterized by the fact that the support is formed by a carriage longitudinally and transversely guided by the rails of a railroad track, and that it comprises means connecting this carriage to a railroad vehicle driving it along the track and lifting means causing relative displacements in height between the carriage and the railroad vehicle.

9. Device according to claim 8, characterized by the fact that it comprises means maintaining flanged wheels of the carriage in lateral contact with the rail to guarantee a guiding of the carriage on the track without play.

* * * * *